United States Patent [19]

Thanisch

[11] Patent Number: 5,067,624

[45] Date of Patent: Nov. 26, 1991

[54] PLASTIC CLOSURE FOR CONTAINERS

[75] Inventor: Klaus Thanisch, Bullay, Fed. Rep. of Germany

[73] Assignee: Zeller Plastik GmbH, Mosel, Fed. Rep. of Germany

[21] Appl. No.: 591,236

[22] Filed: Oct. 1, 1990

[30] Foreign Application Priority Data

Sep. 29, 1989 [DE] Fed. Rep. of Germany ..... 8911643

[51] Int. Cl.[5] ..... B65D 47/08

[52] U.S. Cl. ..... 215/235; 215/237; 220/254; 220/259; 220/335

[58] Field of Search ..... 215/306, 235, 334, 237; 220/337, 338, 341, 259, 254, 255, 339

[56] References Cited

U.S. PATENT DOCUMENTS

| | | | |
|---|---|---|---|
| 4,487,324 | 12/1984 | Ostrowsky | 215/253 |
| 4,666,068 | 5/1987 | Bush | 220/338 X |
| 4,696,408 | 9/1987 | Dubach | 215/237 |
| 4,718,567 | 1/1988 | LaVange | 215/216 |
| 4,759,455 | 7/1988 | Wilson | 215/206 |
| 4,778,071 | 10/1988 | Fillmore | 220/339 X |
| 4,793,501 | 12/1988 | Beck | 215/235 |
| 4,915,268 | 4/1990 | Lay et al. | 220/339 X |

*Primary Examiner*—Stephen Marcus
*Assistant Examiner*—Vanessa Caretto
*Attorney, Agent, or Firm*—Kane Dalsimer Sullivan Levy Eisele and Richard

[57] ABSTRACT

A closure of plastic, especially polypropylene, for the necks of containers, especially bottles. The outer wall (8) of the closure flares lengthwise of the neck from the top end of the closure down to a circumferential line (29) of maximum size and tapers again toward the bottom end of the closure. The bottom part (2) and lid (26) of the closure are joined together by a snap hinge (28). This snap hinge is integral with the bottom part and lid and is situated in their outer walls. The depth of the main part (26.1) of the lid (26) is substantially less than the difference in level of the closure between its circumferential line (29) of maximum size and its upper end. For its connection to the snap hinge (28) the lid has an arm (26.3) on one side. The active elements of the snap hinge are disposed symmetrically with the circumferential line (29). This closure has a lid of relatively small size and can be made with a two-part injection mold which does not need to have any lateral slides.

4 Claims, 3 Drawing Sheets

PLASTIC CLOSURE FOR CONTAINERS

BACKGROUND

The invention relates to a closure in which the exterior of the closure body flares outwardly lengthwise of the neck from the top end of the closure downwardly to a circumferential zone of maximum size or dimension and then tapers downward to the bottom end of the closure. Closures of this general type are known and obtainable on the market and usually injection molded from plastic, especially polypropylene.

If the circumferential line of maximum size is situated at about the middle of the closure and it is desired to utilize a two-part injection mold, i.e., a mold without lateral slides, the prior art required the lid to be made relatively deep. A lid of this type is unacceptable commercially because to the consumer it is too unwieldy and may also interfere with dispensing of product from the container.

SUMMARY OF THE INVENTION

It is therefore an object of the present invention to provide a closure with a circumferential line of maximum size situated far below its top end and with a lid of shallow depth. The closure according to this invention is manufacturable with a two-part mold.

Another object is to provide a closure of the foregoing type with the circumferential line of maximum size occurring in one plane the location of which is not critical. In this regard, the circumferential line could also lie in a curved surface. The cross sections through the closure also need not be circular, but can be oval or of some other shape.

According to the present invention, a closure lid is provided with a main part which is very shallow, due to the fact that the lid is equipped with an arm on one side, which, when the lid is closed, reaches virtually to the circumferential line of maximum size. It does not reach all the way to the circumferential line of maximum size because space must be provided for the active elements of the snap hinge which are disposed between the bottom part and the arm of the lid. The term, "active elements of the snap hinge," refers to the elements which are situated between the bottom of the closure and the arm of the lid.

Snap hinges suitable for application with the present invention are known, for example, from EP-B-0,056,469, or from U.S. Pat. No. 4,403,712 which corresponds approximately thereto, especially FIGS. 15 to 18 of both patent specifications. However, other kinds of snap hinges can also be utilized.

Inasmuch as the lid is equipped with an arm, its main part can be shallow. This lid is also less of an encumbrance to the user than a lid of great depth. A closure in accordance with the invention can be manufactured with a two-part injection mold.

German petty patent specification [Gebrauchsumuster] 1,995,401-WOLF- discloses a snap hinge closure in which the depth of the main part of the lid is less than the difference in elevation between its main hinge axis and the top edge of the bottom part of the closure and the lid accordingly has an arm on one side. In this closure, however, the main axis of the snap hinge is far outside of the bottom part of the closure, resulting in projections on one side of the closure. There projections detract from its appearance and interfere with the installation of the closure by closure machines; and often this makes it impossible to install the closure. According to the present invention, however, a closure is provided which, when closed, offers a symmetrical appearance, and in which no parts project outward when in that state.

In accordance with further embodiments, this invention contemplates configurations such that the arm of the lid in the closed position vanishes in a shallow recess in the bottom part. The result is a pleasing appearance of the closure. No parts protrude outwardly to any appreciable degree, so that the installation of the closure with conventional closing machines is advantageously possible.

By providing sections of the lid arm which are present in the closed state, on both sides of the active hinge elements while extending to the circumferential line of maximum size, the injection mold need not have a knife-sharp edge outside of the outermost hinge elements, which would otherwise make manufacture difficult and shorten the life of the mold.

BRIEF DESCRIPTION OF FIGURES

Other objects and advantages of the present application will become apparent from the following description which is to be taken with accompanying drawings in which.

DETAILED DESCRIPTION

Figure 3:
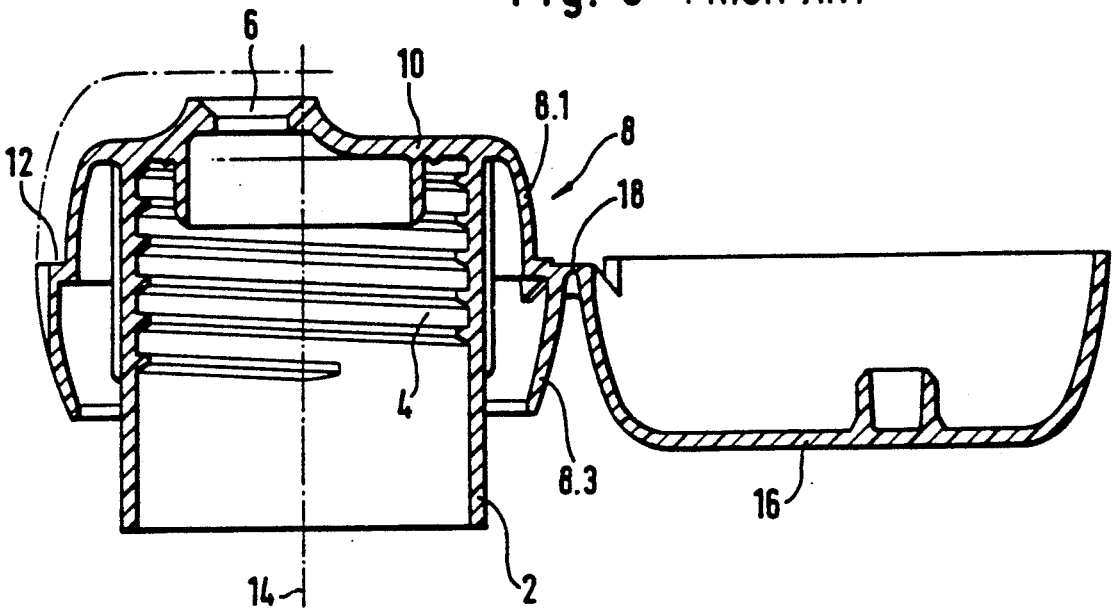
Fig. 3 PRIOR ART
FIG. 3 is an axial section through a closure according to the state of the prior art, shown in the same manner as FIG. 1.
Figure 4:
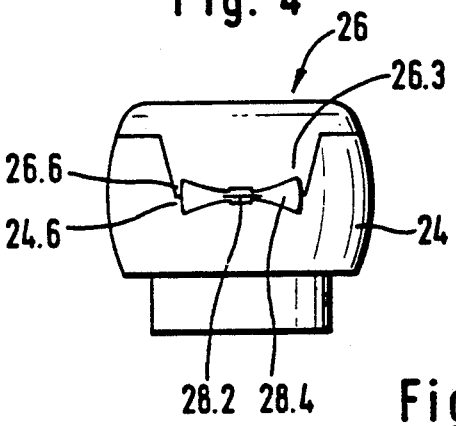
FIG. 4 a rear elevational view of the hinge side of the closure of the present invention.

The known prior art closure according to FIG. 3 has a bottom part 2 with an internal thread 4 for screwing onto the neck of a bottle or container. It has a dispensing hole 6 and an outside wall 8 bulging outward. The upper section 8.1 of the outside wall flares outward from the top 10 of the bottom part toward a plane 12 running transversely of the longitudinal axis 14 of the closure. The lower part there abruptly widens, and the lower section 8.3 of the outside wall then tapers downwardly. The lid 16 is linked by a hinge 18 to the bottom part 2 at the plane 12. The lid is of a slightly greater depth than the upper section 8.1. This depth of the lid is necessary in the state of the prior art if the closure is to be manufactured in a two-piece mold.

Figure 1:
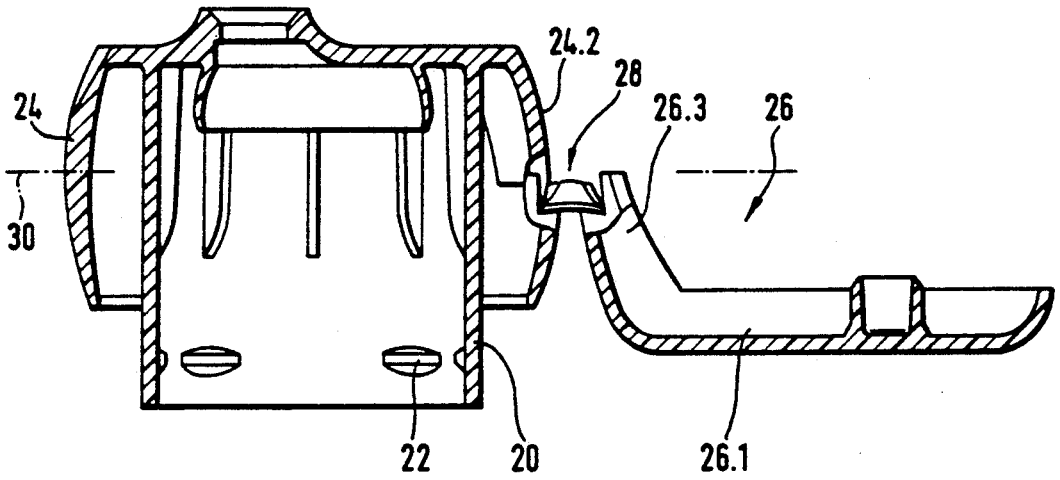
FIG. 1 is an axial section through a closure according to the invention, in the position which it assumes when molded in the injection mold.
Figure 2:
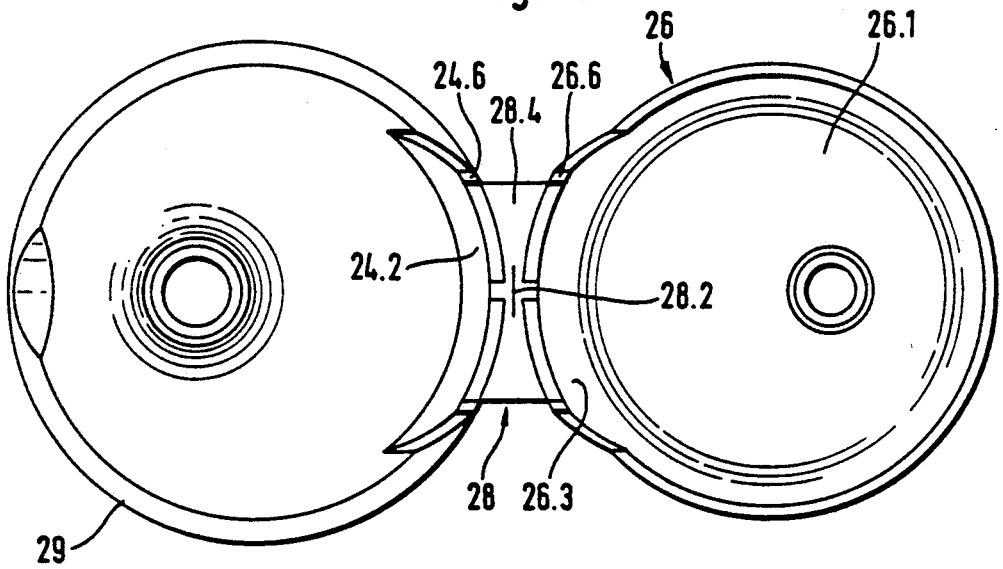
FIG. 2 is a top view of the closure in the same position.
Figure 5:
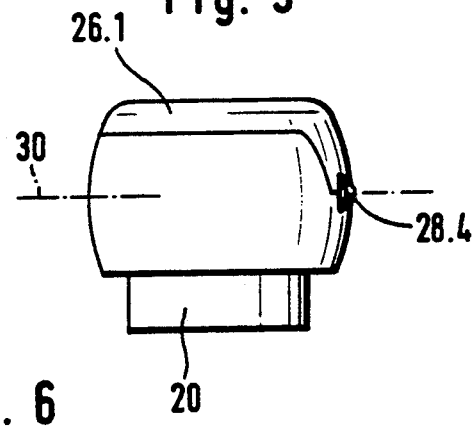
FIG. 5 a side elevational view thereof.
Figure 6:
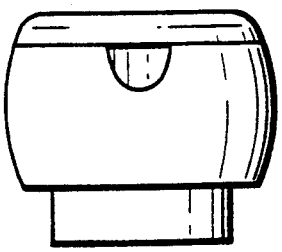
FIG. 6 a front elevational thereof.

The closure in accordance with the present invention is made for example of polypropylene, and has a bottom part 20 which can be fixedly connected to a container neck and held in place by catch projections 22 (FIG. 1) under an outer bead on the neck. (not shown) The bottom part has an outside wall 24 which flares downwardly from the top to the circumferential line 29 of maximum size and then tapers smoothly in again. The circumferential line 29 of maximum size falls in a plane 30 indicated by broken lines in FIGS. 1 and 5. The lid 26 has a main part 26.1 of shallow depth and an arm 26.3 forming the connection of the main part to snap hinge 28. The snap hinge can preferably be configured in accordance with FIGS. 15 to 18 of the above-cited patents, and can have in the center a film hinge 28.2 and an intermediate element 28.4 on either side thereof. The intermediate elements can have little or no extensibility, so that, when the lid snaps open or shut, other portions of the closure, especially the arm 26.3, are resiliently deformed. The intermediate elements 28.4 and the film hinge 28.2 are here together referred to as the active elements of the snap hinge.

Figure 7:
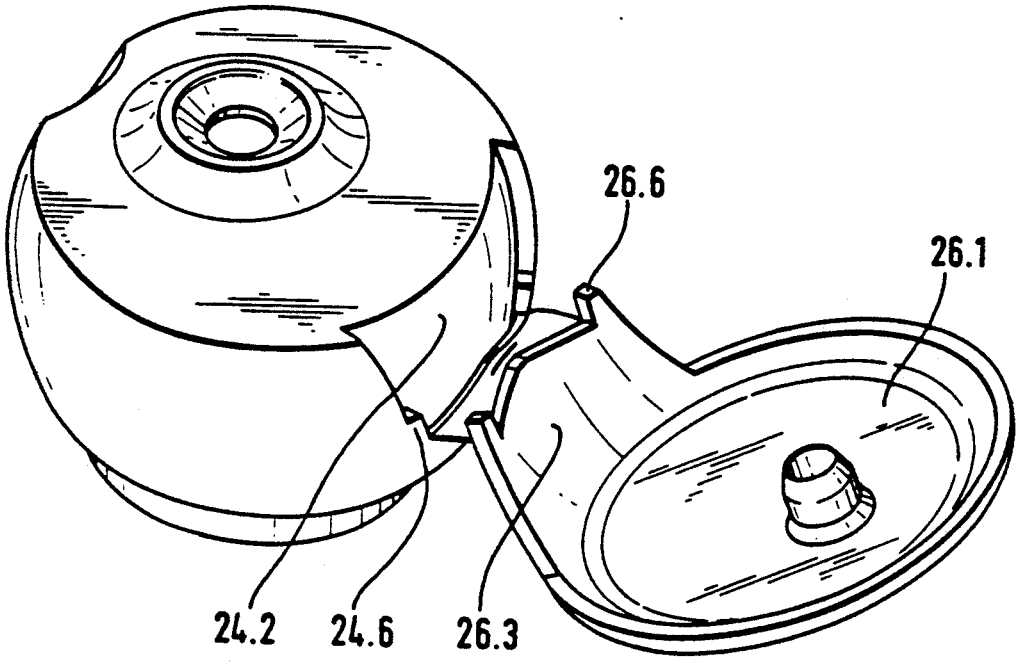
FIG. 7 is a perspective view of the same closure in the open state which it assumes when in use.

In the outer wall 24 of the bottom part there is provided a recess 24.2 (FIG. 7) which serves to receive the arm 26.3 of the lid when the lid is closed. Outside of the intermediate elements 28.4 of the hinge, the arm 26.3 of the lid has a section 26.6. projecting on each side, which in the closed state abuts against a projection 24.6 within the recess 24.2.

Thus, the several aforenoted objects and advantages are obtained by providing a functional, aesthetically pleasing closure with a snap hinge and shallow lid. Although a single preferred embodiment has been disclosed in detail herein it should be understood that this invention is in no sense limited thereby and its scope is to be determined by that of the appended claims.

I claim:

1. A closure of plastic for the necks of containers, the closure having an upper end and a bottom end and comprising:

a) the closure having a bottom part having an outer wall and a lid, wherein the outer wall of the closure flares in a longitudinal direction from the upper end of the closure outwardly and downwardly to a circumferential line of maximum size, and then flares inwardly toward the bottom end of the closure, b) the bottom part and lid of the closure being joined together by a snap hinge (28) disposed in the outer wall and being made in one piece with the closure, said snap hinge (28) comprising a film hinge (28.2) and an intermediate element (28.4) on either side thereof, c) the lid having a main part (26.1), the depth of the main part of the lid being substantially less than the difference in the height of the closure between its circumferential line of maximum size and its upper end, d) the lid having an arm 26.3 forming a connection of the main part (26.1) of the lid to the snap hinge, e) the snap hinge being disposed symmetrically with the circumferential line of maximum size.

2. A closure according to claim 1, wherein the exterior of the outer wall of the bottom part has a shallow recess which in the closed position of the lid serves to accommodate the arm of the lid and the snap hinge.

3. A closure according to claim 2 wherein the arm (26.3) of the lid has sections (26.6) projecting on either side of the intermediate elements (28.9) of the snap hinge (28) and extending to the circumferential line of maximum size, abutting in the closed state against projections (24.6) disposed within the recess.

4. A closure according to claim 1 wherein the closure is made of polypropylene.

* * * * *